US010604923B2

(12) United States Patent
Lee et al.

(10) Patent No.: US 10,604,923 B2
(45) Date of Patent: Mar. 31, 2020

(54) NOZZLE ASSEMBLY AND BIDET DEVICE INCLUDING SAME

(71) Applicant: COWAY CO., LTD, Chungcheongnam-do (KR)

(72) Inventors: Sung-Hee Lee, Seoul (KR); Hee-Ju Kang, Seoul (KR); Sung-Worl Jin, Seoul (KR); Chan-Jung Park, Seoul (KR); Jong-Hyun Park, Seoul (KR); Joong-Keun An, Seoul (KR); Keun-Hwan Kim, Seoul (KR)

(73) Assignee: COWAY CO., LTD., Chungcheongnam-do (KR)

( * ) Notice: Subject to any disclaimer, the term of this patent is extended or adjusted under 35 U.S.C. 154(b) by 59 days.

(21) Appl. No.: 15/118,936

(22) PCT Filed: Feb. 16, 2015

(86) PCT No.: PCT/KR2015/001558
§ 371 (c)(1),
(2) Date: Aug. 15, 2016

(87) PCT Pub. No.: WO2015/122736
PCT Pub. Date: Aug. 20, 2015

(65) Prior Publication Data

US 2016/0356031 A1 Dec. 8, 2016

(30) Foreign Application Priority Data

Feb. 17, 2014 (KR) ..... 10-2014-0017635
Aug. 28, 2014 (KR) ..... 10-2014-0113546

(51) Int. Cl.
*E03D 9/08* (2006.01)

(52) U.S. Cl.
CPC ..... *E03D 9/08* (2013.01)

(58) Field of Classification Search
CPC ..... E03D 9/08
(Continued)

(56) References Cited

U.S. PATENT DOCUMENTS 5,839,129 A 11/1998 Lee
8,291,527 B2 * 10/2012 Pan ..... E03D 9/08 4/443

(Continued)

FOREIGN PATENT DOCUMENTS

CN 101974931 2/2011
CN 102454213 5/2012

(Continued)

OTHER PUBLICATIONS

KR20110017091A Translation.*
JP2011043005 Machine Translation (Year: 2011).*

*Primary Examiner* — J C Jacyna
(74) *Attorney, Agent, or Firm* — Dority & Manning, P.A.

(57) ABSTRACT

A nozzle assembly, according to one embodiment of the present invention, comprises; a nozzle case; a nozzle provided in the nozzle case to move forward and backward, and having an ejection hole at one end thereof; and a moving guide member provided at the lower side of the nozzle case so as to reciprocate in the direction intersecting the longitudinal direction of the nozzle case, wherein the nozzle case is coupled to the moving guide member so as to rotate according to a reciprocating motion of the moving guide member.

18 Claims, 14 Drawing Sheets

(58) Field of Classification Search
USPC ..... 4/420.4, 443, 448
See application file for complete search history.

(56) References Cited

U.S. PATENT DOCUMENTS

| | | | | |
|---|---|---|---|---|
| 8,863,322 | B2 | 10/2014 | Kuang | |
| 2012/0174309 | A1* | 7/2012 | Kuang | E03D 9/08 4/420.4 |
| 2015/0252557 | A1* | 9/2015 | Hashimoto | E03D 5/10 4/406 |
| 2016/0215489 | A1* | 7/2016 | Kim | E03D 9/08 |
| 2017/0051488 | A1* | 2/2017 | Kim | B05B 15/658 |

FOREIGN PATENT DOCUMENTS

| | | | |
|---|---|---|---|
| JP | 2000139761 | | 5/2000 |
| JP | 2000192526 | | 7/2000 |
| JP | 2011043005 | | 3/2011 |
| KR | 200366544 | | 11/2004 |
| KR | 20110017091 | A * | 2/2011 |
| KR | 20100055306 | | 3/2015 |
| KR | 20110017091 | | 6/2016 |

* cited by examiner

【Figure 1】
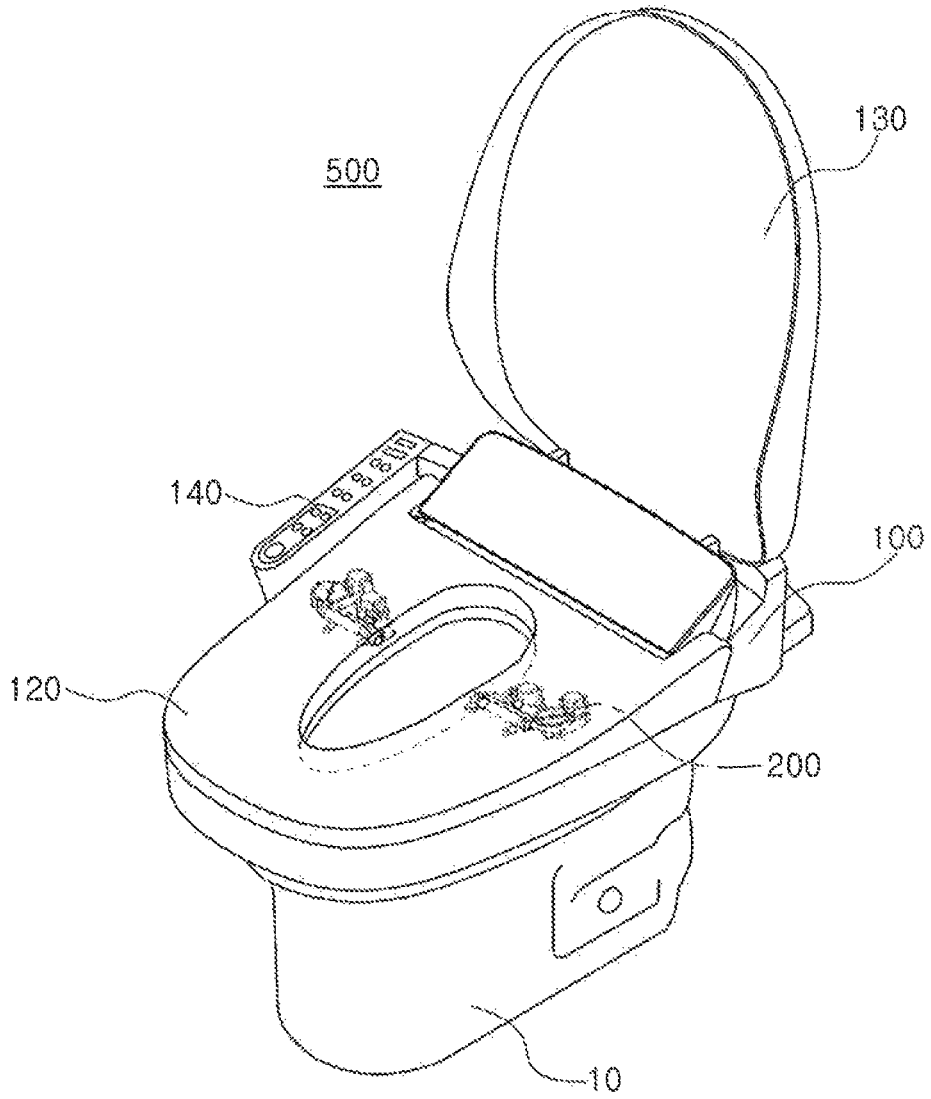

【Figure 2】
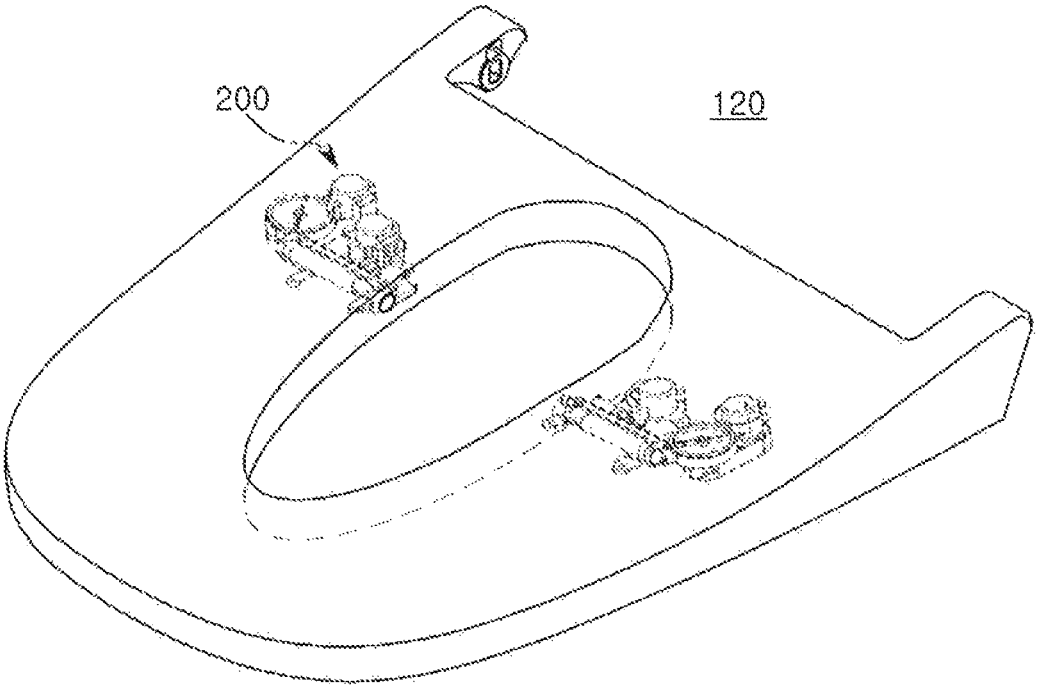

【Figure 3】
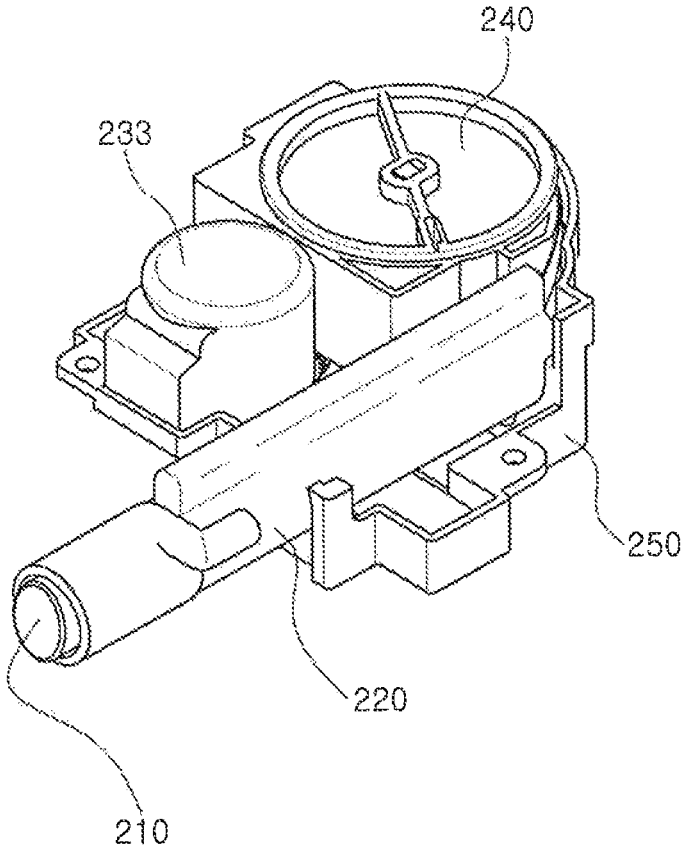

【Figure 4】
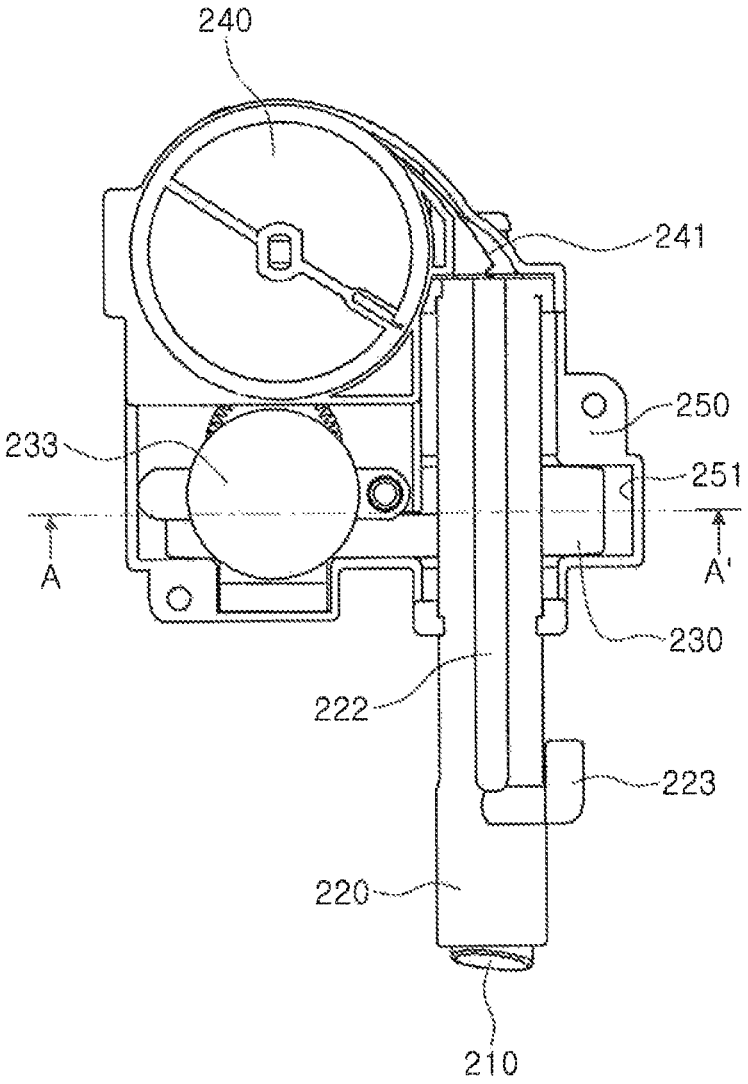

【Figure 5】
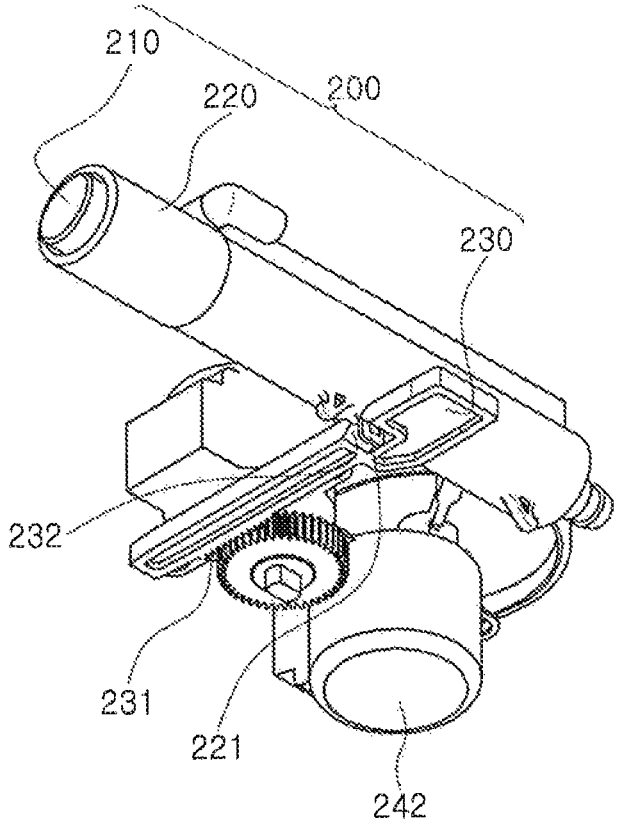

【Figure 6】
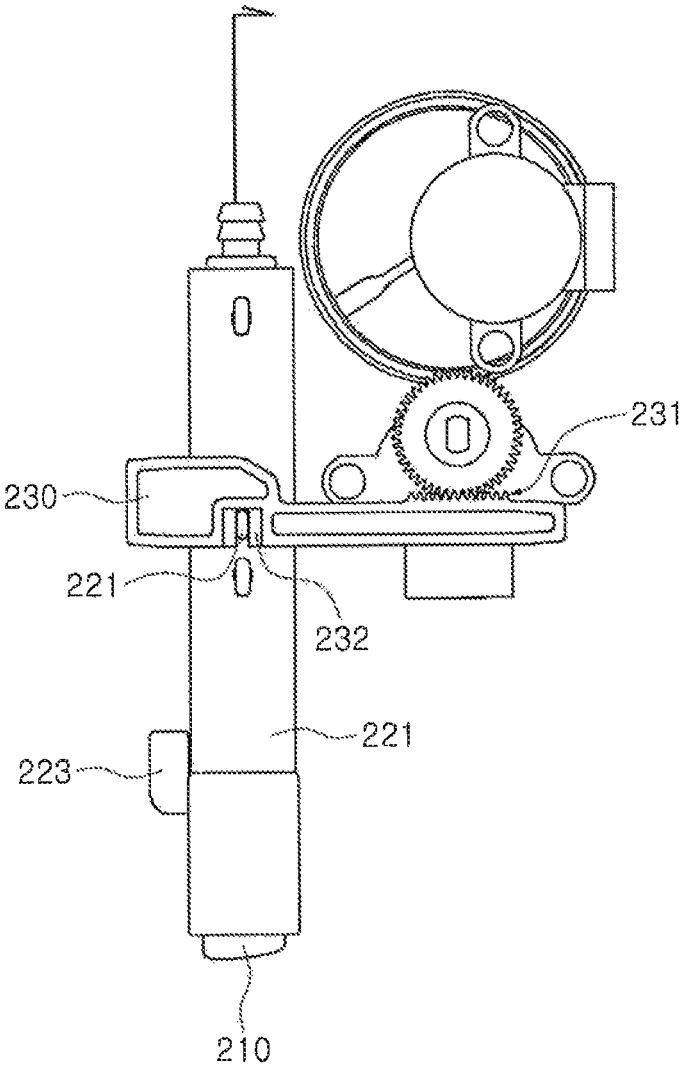

【Figure 7】
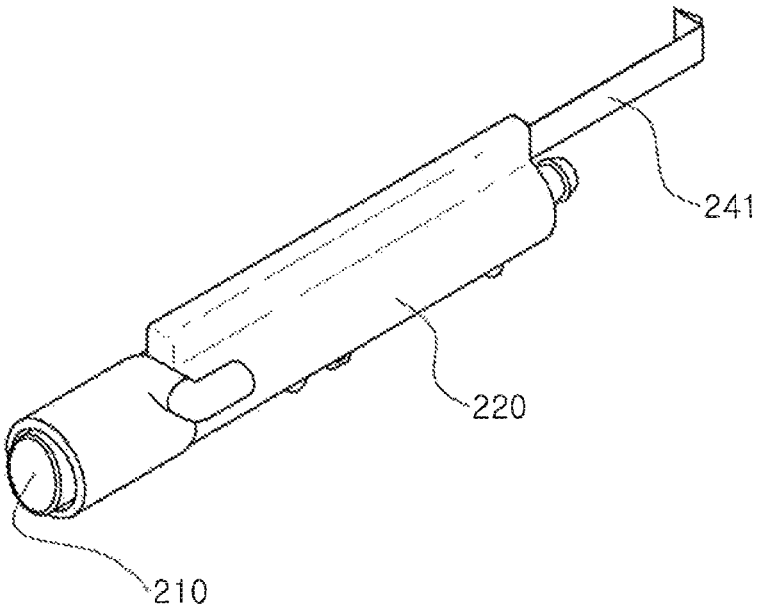

【Figure 8】
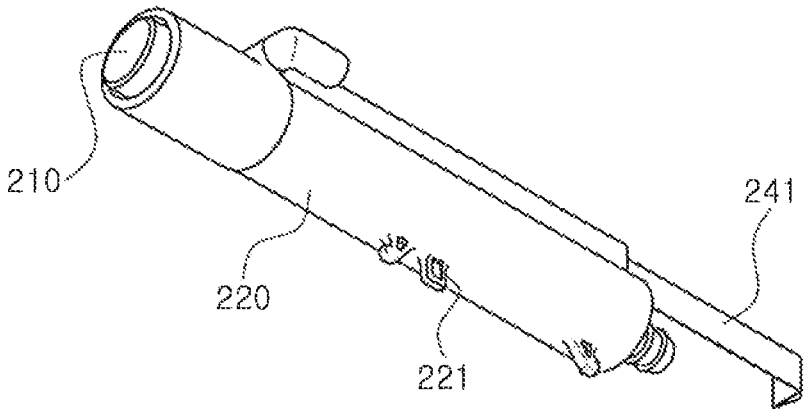

【Figure 9】
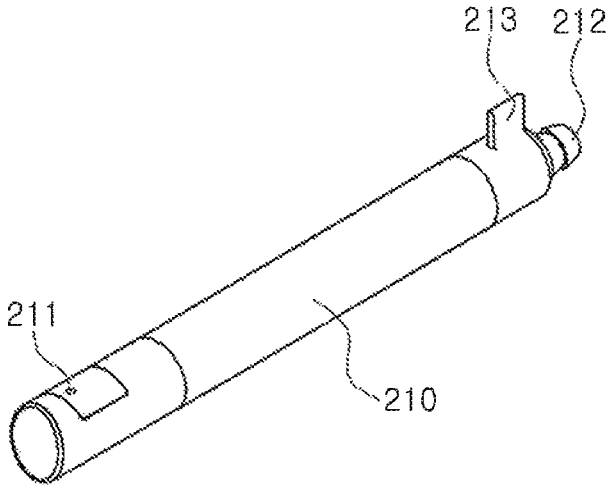

【Figure 10】
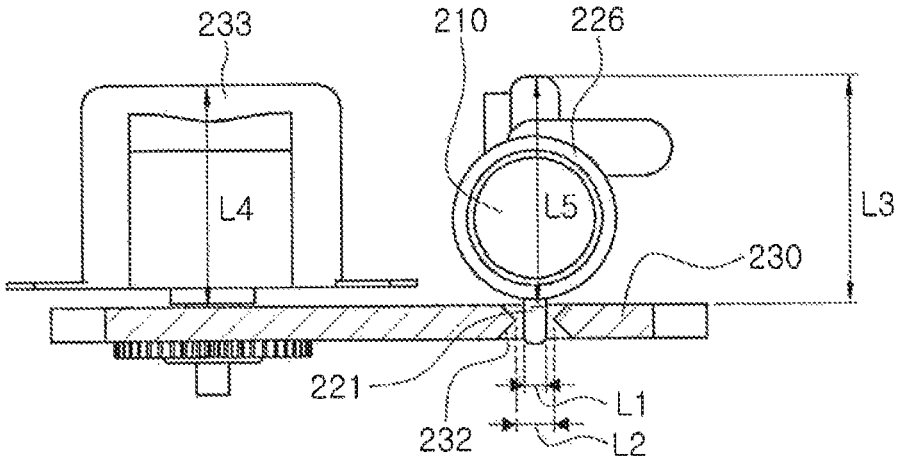
A-A'
(a)
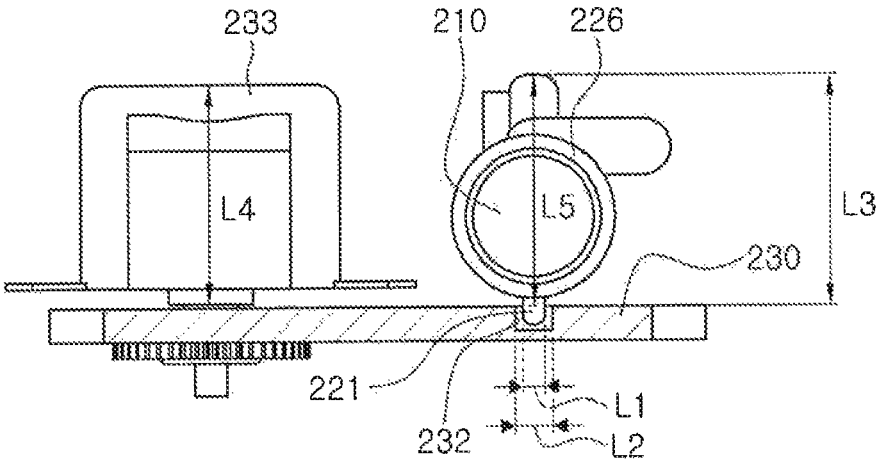
(b)

【Figure 11】
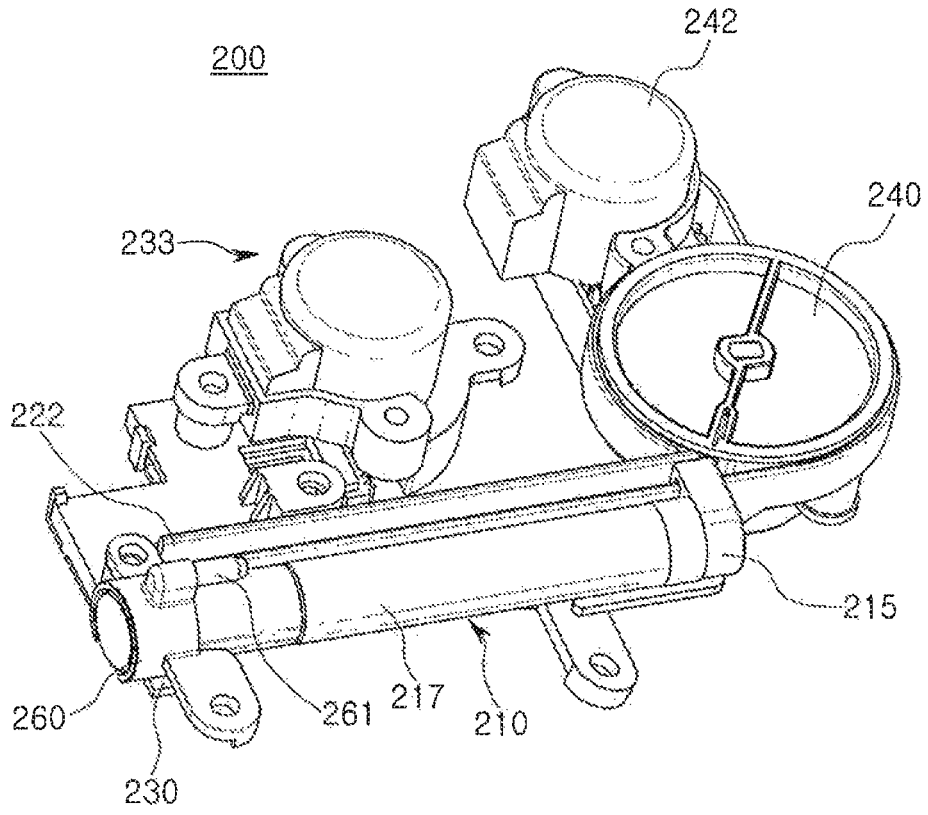

【Figure 12】
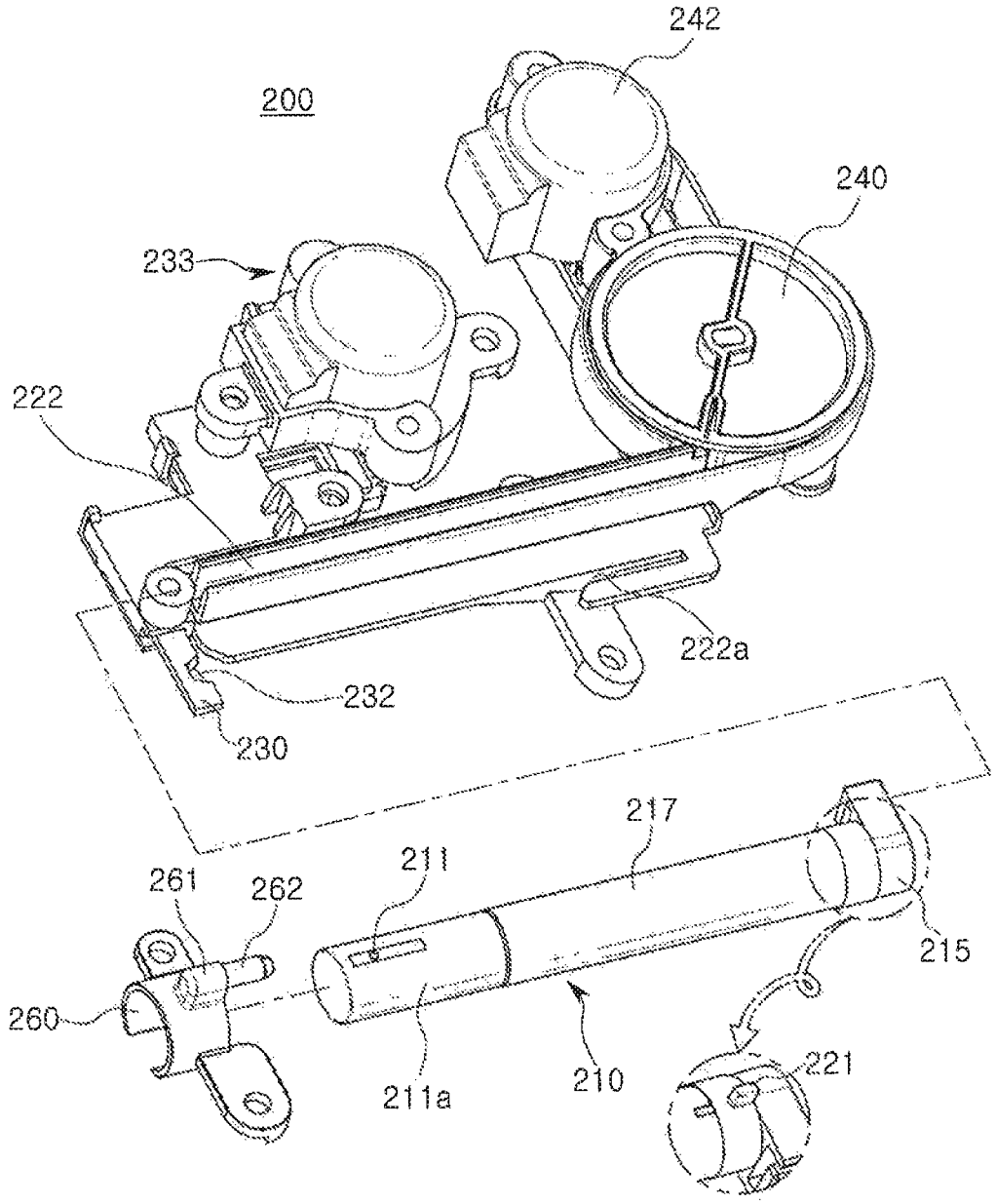

【Figure 13】
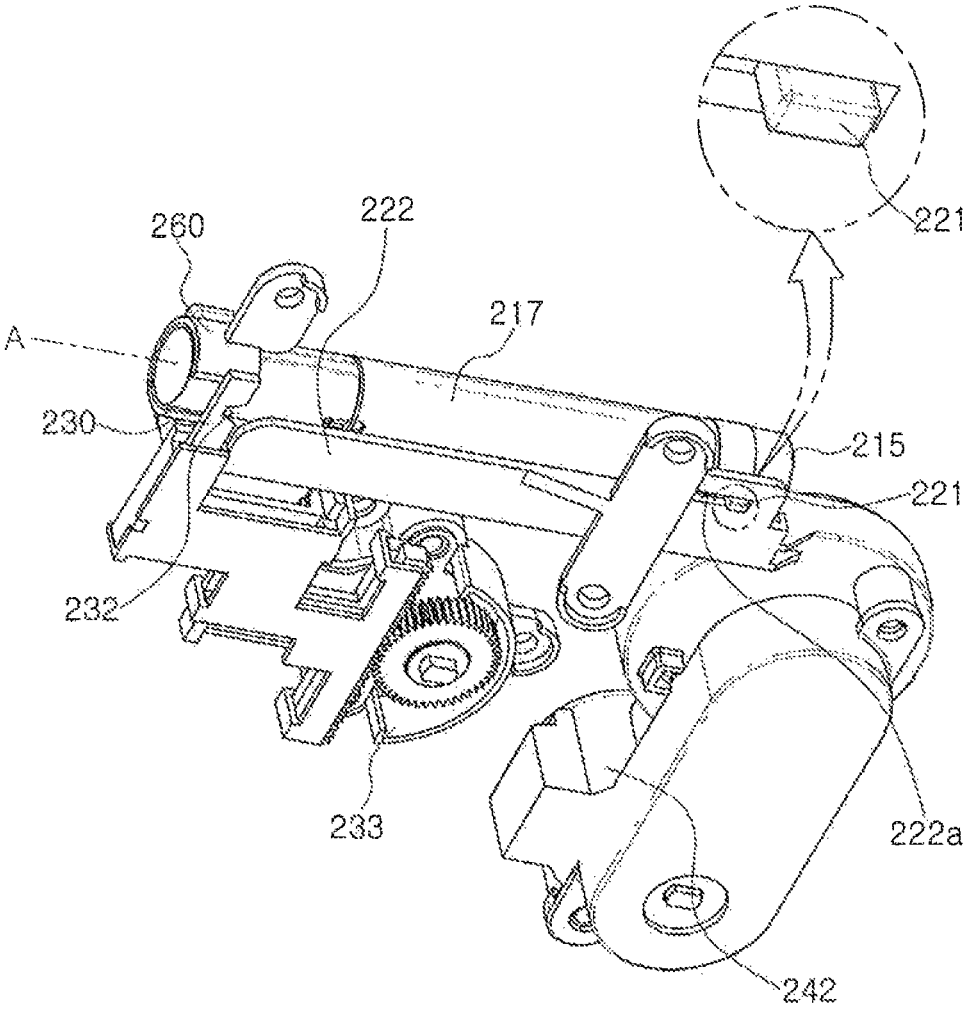

【Figure 14】
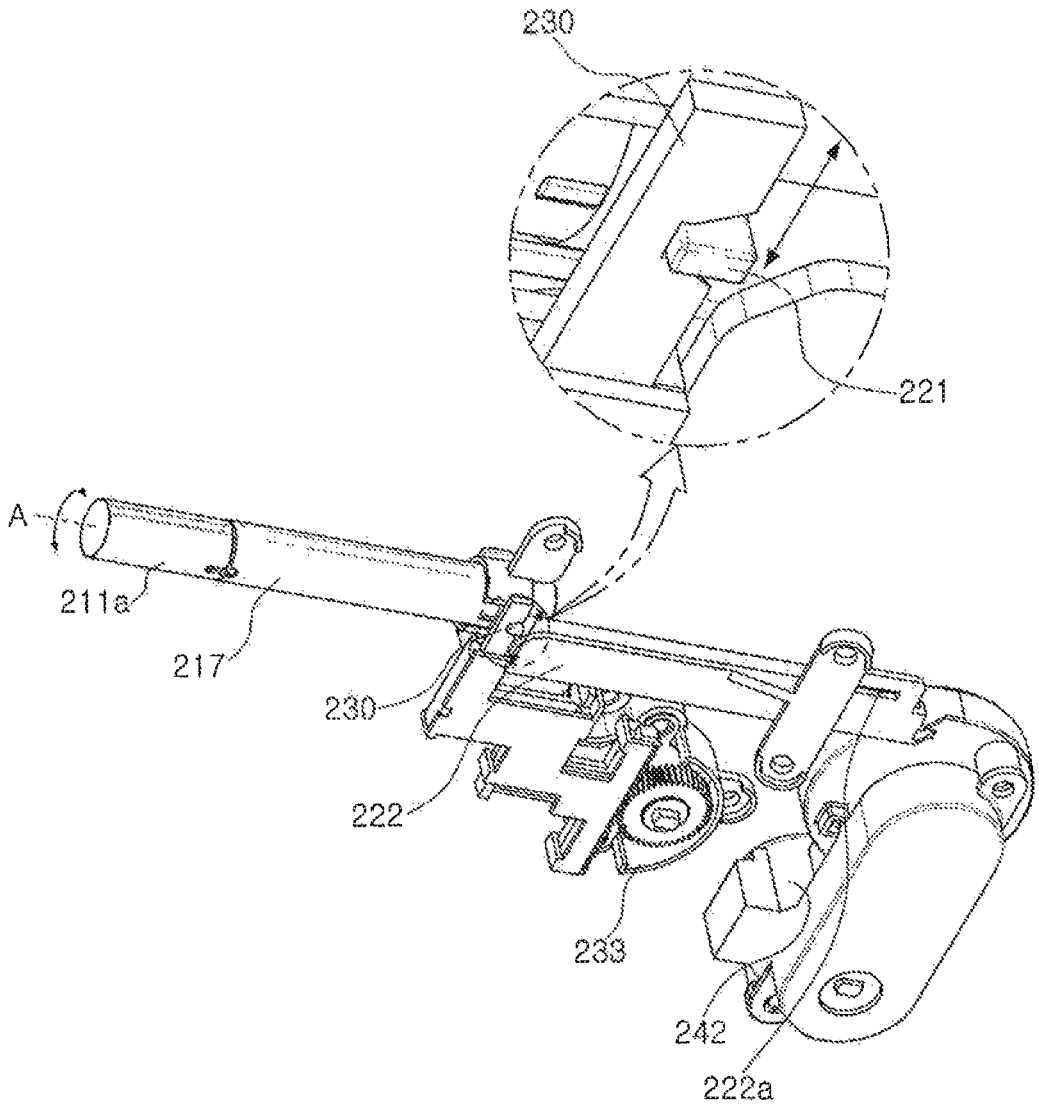

NOZZLE ASSEMBLY AND BIDET DEVICE INCLUDING SAME

CROSS REFERENCE TO RELATED APPLICATIONS

This application is the U.S. National Stage entry of International Application Number PCT/KR2015/1001558 filed under the Patent Cooperation Treaty having a filing date of Feb. 16, 2015, which claims priority to Korean Patent Application Serial Number 10-2014-0113546 having a filing date of Aug. 28, 2014 and Korean Patent Application Serial Number 10-2014-0017635 having a filing date of Feb. 17, 2014, the disclosures of all of which are hereby incorporated by reference herein in their entirety for all purposes.

TECHNICAL FIELD

The present disclosure relates to a nozzle assembly and a bidet device including the same, and more particularly, to a nozzle assembly capable of making a rotational movement and a bidet device including the same.

BACKGROUND ART

A bidet generally installed in a toilet seat jets cleaning water to wash a user's private parts such as the genitalia and the area in the vicinity of the anus, and recently, consumers have increasingly used bidets.

In a bidet, when a user starts a cleaning operation, a cleaning nozzle of the bidet moves to the outside of a bidet body, and the cleaning nozzle receiving cleaning water from a water supply device jets cleaning water to the genitalia or the anus to clean the same.

Meanwhile, in the related art bidet device, a nozzle is provided to only be moved reciprocally in forward/backward direction from the bidet, having difficulty in forming various types of water currents in performing a cleaning operation and causing a problem in that only a limited portion may be cleaned.

Thus, research into a nozzle that may be able to produce various types of water currents and clean a wide area is required.

DISCLOSURE

Technical Problem

Therefore, an object of the present invention is to provide a nozzle assembly capable of performing a linear movement and a rotational movement and a bidet device including the same.

Technical Solution

According to an aspect of the present invention, there is provided a nozzle assembly including: a nozzle case; a nozzle provided to be movable forwardly and backwardly in the nozzle case and having an ejection hole provided in one end thereof; and a movement guide member provided below the nozzle case and reciprocating in a direction perpendicular to a longitudinal direction of the nozzle case, wherein the nozzle case is coupled to the movement guide member and makes a rotational movement according to a reciprocating movement of the movement guide member.

In the nozzle assembly according to an exemplary embodiment of the present disclosure, a tubular protrusion may be provided in the nozzle case and connected to an external water supply device to jet cleaning water to an inner side of the nozzle case to clean the nozzle.

In the nozzle assembly according to an exemplary embodiment of the present disclosure, an outer surface of the nozzle case may be hinge-coupled to a movement guide member.

In the nozzle assembly according to an exemplary embodiment of the present disclosure, a guide protrusion may be formed to protrude from an outer surface of the nozzle case, the movement guide member may have a protrusion connection portion, and the guide protrusion may be inserted into the guide protrusion connection portion.

In the nozzle assembly according to an exemplary embodiment of the present disclosure, the guide protrusion connection portion may be provided as a guide recess recessed to an inner side of the movement guide member.

In the nozzle assembly according to an exemplary embodiment of the present disclosure, a width of the guide recess may be greater than a thickness of the guide protrusion.

In the nozzle assembly according to an exemplary embodiment of the present disclosure, the guide protrusion connection portion may be provided as a guide hole penetrating through the movement guide member.

In the nozzle assembly according to an exemplary embodiment of the present disclosure, a width of the guide hole may be greater than a thickness of the guide protrusion.

In the nozzle assembly according to an exemplary embodiment of the present disclosure, a gear portion may be provided on one side of the movement guide member and connected to a first driving unit to make a reciprocating movement.

In the nozzle assembly according to an exemplary embodiment of the present disclosure, the first driving unit may be provided to be parallel to the nozzle case in a horizontal direction.

In the nozzle assembly according to an exemplary embodiment of the present disclosure, a maximum height of the nozzle assembly in a vertical direction with respect to an upper surface of the movement guide member may be equal to a maximum height of the first driving unit or the nozzle case from the upper surface of the movement guide member in the vertical direction.

In the nozzle assembly according to an exemplary embodiment of the present disclosure, the gear portion may be provided as a rack gear.

In the nozzle assembly according to an exemplary embodiment of the present disclosure, a guide rail protruding outwardly in a radial direction to allow the nozzle to move forwards and backwards within the nozzle case may be provided on one side of the nozzle case.

According to another aspect of the present invention, there is provided a nozzle assembly including: a guide rail; and a nozzle slidably moving along the guide rail and having an ejection hole provided in one end thereof to allow water to be jetted there through, wherein the nozzle rotates centered on a rotational shaft thereof, disposed parallel to a sliding movement direction.

In the nozzle assembly according to an exemplary embodiment of the present disclosure, the nozzle may be connected to a first driving unit, and the first driving unit may provide power to enable the nozzle to rotate.

In the nozzle assembly according to an exemplary embodiment of the present disclosure, the nozzle assembly may further include: a second driving unit connected to the nozzle and providing power enabling the nozzle to slidably move along the movement guide member.

In the nozzle assembly according to an exemplary embodiment of the present disclosure, the nozzle may repeatedly perform operations of rotating in one direction and subsequently rotating in the opposite direction.

In the nozzle assembly according to an exemplary embodiment of the present disclosure, the nozzle may include a connecting member slidably connected to the guide rail and a body part having an ejection hole provided in one end thereof to allow water to be jetted there through and the other end rotatably connected to the connecting member.

In the nozzle assembly according to an exemplary embodiment of the present disclosure, the body part may have a guide protrusion protruding outwardly therefrom, the first driving unit may be connected to a movement guide member linearly moving in a direction perpendicular to a rotational axis of the nozzle, and a guide protrusion connection portion connected to the guide protrusion may be provided in the movement guide member.

In the nozzle assembly according to an exemplary embodiment of the present disclosure, the movement guide member may be positioned at one end of the guide rail, the guide protrusion may be provided to be leaned toward the other end of the body part, and when the nozzle is drawn out, the guide protrusion may be connected to the guide protrusion connection portion.

In the nozzle assembly according to an exemplary embodiment of the present disclosure, the guide protrusion connection portion may have a taped section having a width increased toward an entrance thereof.

In the nozzle assembly according to an exemplary embodiment of the present disclosure, a guide protrusion receiving recess may be provided at the other end of the guide rail, and the guide protrusion may be inserted into the guide protrusion receiving recess when the nozzle is on standby for use.

In the nozzle assembly according to an exemplary embodiment of the present disclosure, the guide protrusion receiving recess may have a taped section having a width increased toward an entrance thereof.

According to another aspect of the present invention, there is provided a bidet device including: a frame to which a seat plate is rotatably coupled; and the foregoing nozzle assembly provided in an internal space of the seat plate.

In the bidet device according to an exemplary embodiment of the present disclosure, the nozzle assembly may be provided on both sides of the seat plate.

Advantageous Effects

Since the nozzle assembly according to embodiments of the present invention has the linearly movable movement guide member, the nozzle case and the nozzle can make a rotational movement by connecting the movement guide member and the nozzle case.

DESCRIPTION OF DRAWINGS

FIG. 1 is a perspective view of a toilet seat including a bidet device according to an exemplary embodiment of the present disclosure.

FIG. 2 is an enlarged view of a seat plate illustrated in FIG. 1.

FIG. 3 is a schematic perspective view of a nozzle assembly according to an exemplary embodiment of the present disclosure.

FIG. 4 is a plan view of a nozzle assembly according to an exemplary embodiment of the present disclosure.

FIG. 5 is a bottom perspective view of a nozzle assembly according to an exemplary embodiment of the present disclosure.

FIG. 6 is a bottom view of a nozzle assembly according to an exemplary embodiment of the present disclosure.

FIG. 7 is a schematic perspective illustrating a configuration in which a nozzle and a nozzle case are coupled according to an exemplary embodiment of the present disclosure.

FIG. 8 is a schematic bottom perspective view illustrating a configuration in which a nozzle and a nozzle case are coupled according to an exemplary embodiment of the present disclosure.

FIG. 9 is a schematic perspective view of a nozzle according to an exemplary embodiment of the present disclosure.

FIG. 10(*a*) is a cross-sectional view taken along line A-A' of FIG. 3, and FIG. 10(*b*) is a cross-sectional view taken along line A-A' of FIG. 4 according to another exemplary embodiment.

FIG. 11 is a perspective view of a nozzle assembly according to another exemplary embodiment of the present disclosure.

FIG. 12 is an exploded perspective view of a nozzle assembly according to another exemplary embodiment of the present disclosure.

FIG. 13 is a bottom perspective view of a nozzle assembly according to another exemplary embodiment of the present disclosure.

FIG. 14 is a perspective view illustrating a state in which a nozzle is drawn out from a nozzle assembly according to another exemplary embodiment of the present disclosure.

BEST MODE FOR INVENTION

Before describing the present disclosure in detail, it should be appreciated that terms or words used in the specification and claims should not be limited and construed as having common or dictionary meanings, and should be construed as having meanings and concepts according to the technical spirit of the present disclosure, based on the principle that the inventor can appropriately define the concept of each term for describing the present disclosure in the best manner. The exemplary embodiment described in the present disclosure and the configuration illustrated in the drawings are merely the most preferred embodiment of the present disclosure, rather than representing all the technical concepts of the present disclosure, so the present disclosure is meant to cover all modifications, similarities and alternatives included in the spirit and scope of the present disclosure at the time of the filing of the present disclosure.

Hereinafter, exemplary embodiments of the present disclosure will be described in detail with reference to the accompanying drawings. Here, in each drawing, like reference numerals refer to like elements. Also, detailed descriptions of known functions and elements which unnecessarily obscure the important points of the descriptions will be omitted. Also, for the same reasons, in the drawings, some elements may be exaggerated, omitted, or schematically illustrated, and the size of each element does not entirely reflect an actual size.

FIG. 1 is a perspective view of a toilet seat 10 having a bidet device 500 according to an exemplary embodiment of the present disclosure, and FIG. 2 is an enlarged view of a seat plate 120 illustrated in FIG. 1.

Referring to FIGS. 1 and 2, the bidet device 500 according to an exemplary embodiment of the present disclosure includes a frame 100 and a nozzle assembly 200.

The frame 100 may be mounted on and couple to an upper portion of a toilet seat 10. Here, in FIG. 1, only a configuration in which the frame 100 is provided on an upper rear portion of the toilet seat 10 is illustrated, but a position of the frame 100 may be variously modified and a position of the nozzle assembly 200 may also be modified accordingly.

The seat plate 120 may be rotatably hinge-coupled to the frame 100, and a user may mount the seat plate 120 on the toilet seat 10 or may lift the seat plate 120 upwards from the toilet seat 10 to use the bidet as necessary.

Here, a hot wire or a hose in which hot water flows may be provided within the seat plate 120 to maintain the seat plate 120 at a predetermined temperature.

The nozzle assembly 200 may be provided in an internal space of the seat plate 120. For example, the nozzle assembly 120 may be provided on both sides or on any one side of the seat plate 120, and a nozzle 210 provided in the nozzle assembly 200 may be drawn out toward a central portion of the toilet seat 10.

In a case in which the nozzle assembly 200 is provided within the seat plate 120, the nozzle assembly 200 may be rotated cooperatively together with the seat plate 120 when the seat plate 120 rotates.

Here, a position of the nozzle assembly 200 is not limited to an interior of the seat plate 120. In other words, the nozzle assembly 200 may be provided on an inner side of the frame 100, and also, in this case, the nozzle 210 provided in the nozzle assembly 200 may move forwards and backwards toward the central portion of the toilet seat 10.

A cover 130 may be rotatably hinge-coupled to the frame 100, and an opening of the toilet seat 10 may be opened and closed by rotating the cover 130. The cover 130 may prevent a foreign object from being introduced to an interior of the toilet seat 10 and may prevent bed smell that may be generated in the toilet seat 10 from spreading outwardly from the toilet seat 10.

An operating unit 140 may be provided on one side of the frame 100 in order to control general driving of the nozzle assembly 200 and the bidet deice 500.

A plurality of buttons allowing the user to select a predetermined function may be provided in the operating unit 140.

FIG. 3 is a schematic perspective view of a nozzle assembly according to an exemplary embodiment of the present disclosure, FIG. 4 is a plan view of a nozzle assembly according to an exemplary embodiment of the present disclosure, FIG. 5 is a bottom perspective view of a nozzle assembly according to an exemplary embodiment of the present disclosure, and FIG. 6 is a bottom view of a nozzle assembly according to an exemplary embodiment of the present disclosure.

Referring to FIGS. 3 to 6, the nozzle assembly 200 according to an exemplary embodiment of the present disclosure includes a nozzle case 220, a nozzle 210, and a movement guide member 230.

The nozzle 210 may be provided to be movable in a forward/backward direction within the nozzle case 220.

A guide rail 222 may be provided on one side of the nozzle case 220 to allow the nozzle 210 to be moved forward/backward on an inner side of the nozzle case 220.

That is, the guide rail 222 may be provided to protrude outwardly in a radial direction from one side of the nozzle case 220, and may be provided in a longitudinal direction of the nozzle case 220.

Here, a protrusion 213 (to be described hereinafter) of the nozzle 210 may be led in to an inner side of the guide rail 222. Accordingly, the nozzle 210 may move forward/backward along the guide rail 222.

In a case in which the nozzle case 220 rotates, the protrusion 213 is caught by the guide rail 222, and thus, the nozzle 210 may rotate in a state of being in contact with the guide rail 222.

The nozzle case 220 may be hinge-coupled to the movement guide member 230 to make a rotational movement.

For example, a guide protrusion 221 may be formed to protrude from the nozzle case 220, and here, the guide protrusion 221 may protrude from a lower outer surface of the nozzle case 220.

The guide protrusion 221 may be inserted into a guide protrusion connection portion 232 of the movement guide member 230, and when the guide protrusion connection portion 232 reciprocates, the guide protrusion 221 may be caught by the guide protrusion connection portion 232 and rotatably moved when the guide member 230 reciprocates, and accordingly, the nozzle case 220 may be entirely rotatably moved.

A tubular protrusion 223 may be provided in the nozzle case 220. The tubular protrusion 223 may be connected to an external water supply device to jet cleaning water to an inner side of the nozzle case 220 to clean the nozzle 210.

Here, the tubular protrusion 223 may be connected to the external water supply device by a connection member such as a hose or a tube to jet cleaning water to the inner side of the nozzle case 220.

For example, the tubular protrusion 223 may be provided to communicate with an upper portion of an ejection hole 211 (to be described hereinafter) provided in the nozzle 210, and thus, cleaning water passing through the tubular protrusion 223 may be jetted toward the ejection hole 211.

FIG. 7 is a schematic perspective illustrating a configuration in which a nozzle and a nozzle case are coupled according to an exemplary embodiment of the present disclosure, FIG. 8 is a schematic bottom perspective view illustrating a configuration in which a no nozzle and a nozzle case are coupled according to an exemplary embodiment of the present disclosure, and FIG. 9 is a schematic perspective view of a nozzle according to an exemplary embodiment of the present disclosure.

Referring to FIGS. 7 to 9, the nozzle 210, which jets cleaning water to the user's anus or genitalia, is provided to be movable forwardly and backwardly on an inner side of the nozzle case 220.

The ejection hole 211 for jetting water supplied from a water supply device may be provided at one end of a front side of the nozzle 210, and a nozzle connector 212 may be provided at the other end of the nozzle 210, to which a hose is connected and water is supplied from the water supply device.

That is, when the bidet device 500 operates, water supplied from the water supply device may be supplied to the nozzle 210 through the nozzle connector 212 and may eventually be jetted through the ejection hole 211 provided in the nozzle 210.

Here, water, passing through the ejection hole 211, may be jetted in the form of a linear water current to the private parts of the user of the bidet device 500, and when water is jetted in the form of the linear water current, the water current may be precisely controlled through a linear and rotational movement of the nozzle 210. The linear and rotational movement of the nozzle 210 will be described in detail hereinafter.

In addition, a jetted form of water which has passed through the election hole 211 in the nozzle assembly 200 according to an exemplary embodiment of the present disclosure is not limited to the linear water current and may be modified to various types of water currents used in the art to which the present disclosure pertains, such as a curved water current, a sprayed water current, and the like.

The protrusion 213 may be provided on one side of the nozzle 210. The protrusion 213 may be movably inserted into the guide rail 222 of the nozzle case 220, and when the nozzle case 220 makes a rotational movement, the protrusion 213 may be caught by the guide rail 222 to cause the nozzle 210 to make a rotational movement.

In the drawing, only a configuration in which the protrusion 213 is provided at the other end of the nozzle 210 is illustrated, but the present disclosure is not limited thereto and the protrusion 213 may be variously modified as long as the protrusion 213 is inserted into the guide rail 222 of the nozzle case 220 and causes the nozzle 210 to make movements forwards and backwards or rotate.

Referring to FIGS. 3 to 6, the movement guide member 230 may be provided in a direction perpendicular to a longitudinal direction of the nozzle case 220 below the nozzle case 220 and may include a gear portion 231 and the guide protrusion connection portion 232 into which the guide protrusion 221 is inserted.

Herein the longitudinal direction of the nozzle case 220 refers to a direction from the ejection hole 211 to the connector 212 or an opposite direction thereof.

The gear portion 231 may be formed on one side of the movement guide member 230, and may be gear-coupled to a first driving unit 233 to cause the movement guide member 230 to reciprocate.

For example, the gear portion 231 may be provided as a linear rack gear on one side of the movement guide member 230 and may be gear-coupled to the first driving unit 233.

Thus, when the first driving unit 233 operates, the movement guide member 230 may reciprocate in a direction perpendicular to the longitudinal direction of the nozzle case 220.

Here, the movement guide member 230 may come into contact with a slit portion 251 of the lower cover 250 so as to be limited in a movement range thereof.

Also, the gear portion 2312 may not be limited to the rack near and may be variously modified as long as the gear portion 231 is connected to the first driving unit 233 to cause the movement guide member 230 to reciprocate.

The first driving unit 233 may be provided as, for example, a motor, and as mentioned above, the first driving unit 233 may be gear-coupled to the movement guide member 230 to cause the movement guide member 230 to linearly reciprocate.

Here, the first driving unit 233 may be provided to be parallel to the nozzle case 220 in a horizontal direction above the movement guide member 230.

Here, the horizontal direction refers to a direction from the left to the right or the opposite direction thereof with respect to (a) and (b) of FIG. 10, and a vertical direction refers to a direction from a lower side to an upper side or the opposite direction thereof with respect to (a) and (b) of FIG. 10.

Thus, the maximum height L3 (please refer to FIG. 10) in the vertical direction of the nozzle assembly 200 with respect to an upper surface of the movement guide member 230 may be equal to a maximum height L2 (please refer to FIG. 10) of the first driving unit 233 from an upper surface of the movement guide member 230 in a vertical direction or a maximum height L5 (please refer to FIG. 10) of the nozzle case 210 from the upper surface of the movement guide member 230 in the vertical direction.

In other words, in the nozzle assembly 200 according to an exemplary embodiment of the present disclosure, the first driving unit 233 and the nozzle case 220 are disposed in a horizontal direction, minimizing a width of the nozzle assembly 200 in the vertical direction.

Referring to (a) of FIG. 10, the guide protrusion connection portion 232 of the movement guide member 230 may be provided as a guide hole 232 penetrating through the movement guide member 230. In this case, a width L2 of the guide hole 232 may be greater than a width L1 of the guide protrusion 221. Thus, a space allowing the guide protrusion 221 to make a rotational movement may be formed between the guide hole 232 and the guide protrusion 221.

Referring to (b) of FIG. 10, the guide protrusion connection portion 232 of the movement guide member 230 may be provided as a guide recess 232 formed to be recessed inwardly from the movement guide member 230. In this case, a width L2 of the guide recess 232 may be greater than the width L1 of the guide protrusion 221. Thus, a space allowing the guide protrusion 221 to make a rotational movement may be formed between the guide recess 232 and the guide protrusion 221.

A process in which the nozzle assembly 200 according to an exemplary embodiment of the present disclosure makes a rotational movement will be described with reference to (a) and (b) of FIG. 10. When the first driving unit 233 operates, the movement guide member 230 reciprocates horizontally with respect to (a) and (b) of FIG. 10.

Here, the guide protrusion 221 is caught by the guide protrusion connection portion 232 of the movement guide member 230 and makes a rotational movement in a clockwise or counterclockwise direction as the movement guide member 230 reciprocates.

As a result, the entirety of the nozzle case 220 makes a rotational movement in a clockwise or counterclockwise direction centered on a rotational axis parallel to a direction in which the nozzle 210 is moved by the first driving unit 23.

Meanwhile, since the protrusion 213 of the nozzle 210 is insertedly coupled to the guide rail 222 of the nozzle case 220, when the nozzle case 220 makes a rotational movement, the nozzle 210 makes a rotational movement together with the nozzle case 220.

Thus, the nozzle assembly 200 according to an exemplary embodiment of the present disclosure may make a rotational movement by the first driving unit 233.

The nozzle assembly 200 may be coupled to a winding member 240 and a lower cover 250

The winding member 240, which is provided to implement a forward/backward linear movement of the nozzle 210, includes a second driving unit 242 and a connection member 241 (please refer to FIG. 7).

The connection member 2241 may be coupled to the protrusion 213 of the nozzle 210 and may move along the guide rail 222 of the nozzle case 220.

In other words, the winding member 240 may allow the connection member 241 to be wound therearound or drawn out therefrom by the second driving unit 242. When the connection member 241 is wound around the winding member 240, the nozzle 210 moves backwards, and when the connection member 241 is drawn out, the nozzle 210 may move forwards.

The nozzle assembly 200, the driving motor 233, and the winding member 240 may be mounted on the lower cover 250, and the nozzle assembly 200 may be provided within the seat plate 120, in a state of being mounted on the lower cover 250.

As described above, the nozzle assembly 200 according to an exemplary embodiment of the present disclosure may be moved forwards and backwards by the winding member 240 and makes a rotational movement by means of the movement guide member 230 provided therein.

Also, the winding member 240 and the movement guide member 230 are also independently driven by the second driving unit 242 and the first driving unit 233, respectively, the nozzle assembly 200 according to an exemplary embodiment of the present disclosure may also be able to make movement combinations of a linear movement and a rotational movement.

As a result, since the nozzle assembly 200 according to an exemplary embodiment of the present disclosure is able to make a rotational movement in addition to an existing linear movement, the nozzle assembly 200 is able to generate various types of water currents and perform cleaning on a larger area.

Hereinafter, a configuration of a nozzle assembly according to another exemplary embodiment of the present disclosure will be described with reference to FIGS. 11 to 14.

FIG. 11 is a perspective view of a nozzle assembly according to another exemplary embodiment of the present disclosure, FIG. 12 is an exploded perspective view of a nozzle assembly according to another exemplary embodiment of the present disclosure, FIG. 13 is a bottom perspective view of a nozzle assembly according to another exemplary embodiment of the present disclosure, and FIG. 14 is a perspective view illustrating a state in which a nozzle is drawn out from a nozzle assembly according to another exemplary embodiment of the present disclosure.

Referring to FIGS. 11 to 14, the nozzle assembly according to another exemplary embodiment of the present disclosure may include a guide rail 222, a nozzle 210, a first driving unit 233, a second driving unit 242, and a nozzle duct 2150.

The guide rail 222 may serve to guide movement of the nozzle 2100. Also, the guide rail 222 may have a guide protrusion receiving recess 222*a* into which a guide protrusion 221 (to be described hereinafter) is inserted when the nozzle 210 is on standby for use.

The guide protrusion receiving recess 222*a* may have a tapered section having a width increased toward an entrance into which the guide protrusion 221 is inserted.

The nozzle 210 may be mounted on the guide rail 222 to slidably move along the guide rail 222, and let water to the private parts of a user upon receiving water from a separate water supply device (not shown). In other words, the nozzle 210 may move along the guide rail 222 so as to be drawn out to jet water to the private parts of a user.

Also, when the water jetting operation terminates, the nozzle 210 may move along the guide rail 222 again so as to be returned to the standby state for use.

The nozzle 210 may rotate, centered on a rotational axis A parallel to a movement direction. Accordingly, a position to which water is jetted may be adjusted, and since the nozzle 210 makes a rotational and reciprocating movement at a predetermined angle, the nozzle 210 may perform a "move function" when jetting water.

For example, the nozzle 210 may repeatedly perform operations of rotating in one direction and subsequently rotating in the other direction.

Here, the nozzle 2100 may include a connecting member 215 slidably connected to the guide rail 222 and a body part 217 connected to the connecting member 215.

Here, an ejection hole 211 jetting water may be provided at one end of the body part 217, and the other end of the body part 217 may be connected to the connecting member 215. Here, the body part 217 may be rotatably connected to the connecting member 215 and a rotational axis A thereof may be parallel to a movement direction of the nozzle 210.

A guide protrusion 221 protruding outwardly in a radial direction may be provided at the other end of the body part 217, that is, at the opposite side of the one end of the body part 217 where the ejection hole 211 is provided.

In other words, the guide protrusion 221 may be provided to be leaned toward the other side of the body part 217.

Referring to FIG. 13, the guide protrusion 221 may be disposed in the guide protrusion receiving recess 222*a* when the nozzle 210 is on standby for use.

As discussed above, the guide protrusion receiving recess 222*a* may have a tapered section having a width increased toward the entrance thereof, and accordingly, even when the body part 217 rotates so the guide protrusion 221 deviates from a normal position, the guide protrusion 221 may be easily inserted into the guide protrusion receiving recess 222*a*.

Also, referring to FIG. 14, the guide protrusion 221 may be inserted into a guide protrusion connection portion 232 provided in a movement guide member 230 (to be described hereinafter) when the nozzle 210 is drawn out. Accordingly, when the movement guide member 230 makes a linear movement in a direction perpendicular to a rotational axis of the nozzle 210, the guide protrusion 221 inserted into the guide protrusion connection portion 232 moves to correspond thereto, and accordingly, the body part 217 may rotate.

The body part 217 may have a detachable nozzle tip 211*a* at a front end thereof. Here, the ejection hole 211 may be formed in the nozzle tip 2121*a*.

The first driving unit 233 may be connected to the nozzle 210 and provide power enabling the nozzle 210 to rotate. To this end, the first driving unit 233 may be gear-coupled to the movement guide member 230 which moves linearly in a direction perpendicular to a rotational axis of the nozzle.

The movement guide member 230 may be positioned at one end of the guide rail 222 and have the guide protrusion connection portion 232 into which the guide protrusion 221 is inserted when the nozzle 210 is drawn out. Here, the guide protrusion connection portion 232 may have a recess shape including a tapered section having a width increased toward an entrance thereof into which the guide protrusion 221 is inserted. Accordingly, even when the body part 217 rotates so the guide protrusion 221 deviates from a normal position thereof, the guide protrusion 221 may be easily inserted into the guide protrusion connection portion 232.

Here, any component may be applied as the first driving unit 233 without a limitation as long as it can transmit power to the movement guide member 230.

The second driving unit 242 is connected to the nozzle 210 and provides power enabling the nozzle 210 to slidably move along the guide rail 222. In other words, the second driving unit 212 may be connected to the connection member 215 and provide power enabling the nozzle 210 to slidably move along the guide rail 222.

Here, there is no limitation in a structure or a type of the second driving unit 242, and any configuration may be applied to the second driving unit 242 without a limitation as long as it can move the nozzle 210.

A nozzle duct 260 is fixedly installed at a front end of the guide rail 222 and allows the nozzle 210 to pass therethrough.

The nozzle duct 260 may include a magnetic cleaning member 261 with a cleaning water inlet 262 to cleaning water to the nozzle tip 211*a* provided in the nozzle 210 when the nozzle 210 is on standby for use.

For example, when the nozzle 210 is on standby for use, the cleaning water inlet 262 may be connected to communicate with an upper portion of the nozzle tip 211*a* and the cleaning water inlet 262 may be connected to a separate water supply device. Thus, when the nozzle 210 is on standby for use, the magnetic cleaning member 261 may remove faces from the nozzle tip 211*a*.

Hereinafter, an operational process of the nozzle assembly 200 according to another exemplary embodiment of the present disclosure will be described.

Referring to FIG. 13, when the nozzle 210 is on standby for use, the guide protrusion 221 is in a state of being inserted into the guide protrusion receiving recess 222*a*.

Here, when the user operates the nozzle assembly 200, the nozzle 210 moves along the guide rail 222 by the second driving unit 242 so as to be drawn out as illustrated in FIG. 14. At this time, the guide protrusion 221 is inserted into the guide protrusion connection portion 232 formed in the movement guide member 230 positioned at a front end of the guide rail 222 according to movement of the nozzle 210.

Here, since the guide protrusion connection portion 232 has a tapered section having a width increased toward an entrance thereof, the guide protrusion 221 may be easily inserted into the guide protrusion connection portion 232.

In the drawn-out state, when the movement guide member 230 moves linearly, the guide protrusion 221 rotates to correspond thereto, and accordingly, the body part 217 of the nozzle 210 rotates. Thus, the user may adjust an injection position of water in a forward/backward direction.

Also, when the user selects the "move function", the movement guide member 230 may make a linear reciprocating movement, and thus, the body part 217 may make rotational reciprocating movement.

Thus, since an injection position of water discharged from the ejection hole 211 is repeatedly changed in forward and backward directions, the "move function" may be performed.

Thereafter, when water injection is completed, the nozzle 210 moves along the guide rail 222 so as to return to the position on standby for use. Here, since the tapered section having a width increased toward the entrance thereof is present in the guide protrusion receiving recess 222*a*, the guide protrusion 221 may be easily installed in the guide protrusion receiving recess 222*a*.

While embodiments have been shown and described above, it will be apparent to those skilled in the art that modifications and variations could be made without departing from the scope of the present disclosure as defined by the appended claims.

The invention claimed is:

1. A nozzle assembly comprising:

a nozzle case;

a nozzle provided to be movable forwardly and backwardly in the nozzle case and having an ejection hole provided in one end thereof; and a movement guide member provided below the nozzle case and reciprocating in a direction perpendicular to a longitudinal direction of the nozzle case, wherein the nozzle case comprises a guide protrusion formed to protrude from an outer surface of the nozzle case coupled to a protrusion connection portion of the movement guide member, and wherein the nozzle case is configured to makes a rotational movement center on a rotational axis disposed at the center of the nozzle and parallel to a longitudinal direction of the nozzle case when a reciprocating movement of the movement guide member contacts the guide protrusion.

2. The nozzle assembly of claim 1, wherein a tubular protrusion is provided in the nozzle case and connected to an external water supply device to jet cleaning water to an inner side of the nozzle case to clean the nozzle.

3. The nozzle assembly of claim 1, wherein the guide protrusion connection portion is provided as a guide recess recessed to an inner side of the movement guide member.

4. The nozzle assembly of claim 3, wherein a width of the guide recess is greater than a thickness of the guide protrusion.

5. The nozzle assembly of claim 1, wherein the guide protrusion connection portion is provided as a guide hole penetrating through the movement guide member.

6. The nozzle assembly of claim 5, wherein a width of the guide hole is greater than a thickness of the guide protrusion.

7. The nozzle assembly of claim 1, wherein a gear portion is provided on one side of the movement guide member and connected to a first driving unit to make a reciprocating movement.

8. The nozzle assembly of claim 7, wherein the first driving unit is provided to be parallel to the nozzle case in a horizontal direction.

9. The nozzle assembly of claim 8, wherein a maximum height of the nozzle assembly in a vertical direction with respect to an upper surface of the movement guide member is equal to a maximum height of the first driving unit or the nozzle case from the upper surface of the movement guide member in the vertical direction.

10. The nozzle assembly of claim 7, wherein the gear portion is provided as a rack gear.

11. The nozzle assembly of claim 1, wherein a guide rail protruding outwardly in a radial direction to allow the nozzle to move forwards and backwards within the nozzle case is provided on one side of the nozzle case.

12. A nozzle assembly comprising:

a guide rail; and a nozzle slidably moving along the guide rail, wherein the nozzle is connected to a first driving unit, and the first driving unit provides power to enable the nozzle to rotate, wherein the nozzle is connected to a second driving unit, and the second driving unit provides power enabling the nozzle to slidably move along a movement guide member, wherein the nozzle includes a connecting member slidably connected to the guide rail and a body part having an ejection hole provided in one end thereof to allow water to be jetted therethrough and the other end rotatably connected to the connecting member, wherein the body part has a guide protrusion protruding outwardly therefrom, the first driving unit is connected to a movement guide member configured to reciprocate linearly in a direction perpendicular to a rotational axis of the nozzle, and a guide protrusion connection portion connected to the guide protrusion is provided in the movement guide member, wherein the nozzle is configured to make a rotational movement centered on a rotational shaft disposed at the center of the nozzle and parallel to a sliding movement direction when a linear reciprocating movement of the movement guide member contacts the guide protrusion; and wherein the movement guide member is positioned at one end of the guide rail, the guide protrusion is provided to be leaned toward the other end of the body part, and when the nozzle is drawn out, the guide protrusion is connected to the guide protrusion connection portion.

13. The nozzle assembly of claim 12, wherein the nozzle repeatedly performs operations of rotating in one direction and subsequently rotating in the opposite direction.

14. The nozzle assembly of claim 12, wherein the guide protrusion connection portion has a tapered section having a width increased toward an entrance thereof.

15. The nozzle assembly of claim 12, wherein a guide protrusion receiving recess is provided at the other end of the guide rail, and the guide protrusion is inserted into the guide protrusion receiving recess when the nozzle is on standby for use.

16. The nozzle assembly of claim 15, wherein the guide protrusion receiving recess has a tapered section having a width increased toward an entrance thereof.

17. A bidet device comprising:

a frame to which a seat plate is rotatably coupled; and the nozzle assembly of claim 1 provided in an internal space of the seat plate.

18. The bidet device of claim 17, wherein the nozzle assembly is provided on both sides of the seat plate.

* * * * *